US010377516B2

(12) United States Patent
Slurink

(10) Patent No.: US 10,377,516 B2
(45) Date of Patent: Aug. 13, 2019

(54) FILLING DEVICE

(71) Applicant: Sluis Cigar Machinery B.V., Kampen (NL)

(72) Inventor: Oscar Slurink, Heino (NL)

(73) Assignee: Sluis Cigar Machinery B.V., Kampen (NL)

( * ) Notice: Subject to any disclaimer, the term of this patent is extended or adjusted under 35 U.S.C. 154(b) by 290 days.

(21) Appl. No.: 15/311,249

(22) PCT Filed: May 13, 2015

(86) PCT No.: PCT/NL2015/050342
§ 371 (c)(1),
(2) Date: Nov. 15, 2016

(87) PCT Pub. No.: WO2015/174841
PCT Pub. Date: Nov. 19, 2015

(65) Prior Publication Data

US 2017/0217607 A1 Aug. 3, 2017

(30) Foreign Application Priority Data

May 16, 2014 (NL) ..... 2012831

(51) Int. Cl.
*B65B 3/12* (2006.01)
*B65B 39/12* (2006.01)
(Continued)

(52) U.S. Cl.
CPC ..... *B65B 3/12* (2013.01); *B65B 3/003* (2013.01); *B65B 3/30* (2013.01); *B65B 39/12* (2013.01);
(Continued)

(58) Field of Classification Search
CPC .... B65B 3/04; B65B 3/12; B65B 3/30; B65B 3/32; B65B 3/323; B65B 39/12;
(Continued)

(56) References Cited

U.S. PATENT DOCUMENTS 2,749,007 A * 6/1956 Fechheimer ..... B65B 39/145 141/101
3,056,436 A * 10/1962 Fechheimer ..... B65B 43/60 141/116
(Continued)

FOREIGN PATENT DOCUMENTS

WO 2010/018139 A1 2/2010
WO 2013/124728 A1 8/2013

*Primary Examiner* — Timothy L Maust
(74) *Attorney, Agent, or Firm* — Hoffmann & Baron, LLP

(57) ABSTRACT

A filling device, in particular for filling liquid containers of electronic cigarettes with a liquid, includes: a rotary carrousel configured to rotate about a main axis of rotation, a pump cam track extending about the main axis, where the rotary carrousel includes multiple hose pumps arranged in an annular configuration about the main axis, where each hose pump includes: a hose, a rotary pump device, the rotary pump device including: a roller rotor including a number of rollers which are configured to engage the hose and urge the liquid through the hose, a cam rotor including a number of pump cams which are configured to engage the pump cam track, the cam rotor being coupled to the roller rotor.

20 Claims, 10 Drawing Sheets

(51) Int. Cl.

| | |
|---|---|
| ***B65B 39/14*** | (2006.01) |
| ***B65B 3/00*** | (2006.01) |
| ***B65B 3/30*** | (2006.01) |
| ***F04B 43/12*** | (2006.01) |
| ***F04B 23/04*** | (2006.01) |

(52) U.S. Cl.
CPC ..... *B65B 39/145* (2013.01); *F04B 23/04* (2013.01); *F04B 43/1253* (2013.01)

(58) Field of Classification Search
CPC ..... B65B 39/145; F04B 23/04; F04B 23/06; F04B 43/1253
USPC ..... 141/144–148
See application file for complete search history.

(56) References Cited

U.S. PATENT DOCUMENTS

| | | | | |
|---|---|---|---|---|
| 3,580,299 | A * | 5/1971 | Alkalay | B67C 3/16 141/116 |
| 3,837,378 | A * | 9/1974 | Kanki | B65B 3/003 141/146 |
| 4,508,148 | A * | 4/1985 | Trechsel | B65B 3/36 141/140 |
| 5,417,260 | A * | 5/1995 | Perrier | B67C 3/206 141/140 |
| 5,947,167 | A * | 9/1999 | Bogen | B01L 3/0293 141/1 |
| 6,761,191 | B2 * | 7/2004 | Rosen | B67C 3/001 134/168 C |
| 2013/0343938 | A1 * | 12/2013 | Hutchison | B41J 2/175 417/477.7 |
| 2017/0217615 | A1 * | 8/2017 | Slurink | B65B 39/12 |

* cited by examiner

FILLING DEVICE

CROSS-REFERENCE TO RELATED APPLICATIONS

This application is the National Stage of International Application No. PCT/NL2015/050342 filed May 13, 2015, which claims the benefit of Netherlands Application No. NL 2012831, filed May 16, 2014, the contents of which is incorporated by reference herein.

FIELD OF THE INVENTION

The present invention relates to a filling device for filling liquid containers, in particular liquid containers of electronic cigarettes. The present invention further relates to a method of filling liquid containers, and to a hose pump suitable to be used in the filling device.

BACKGROUND OF THE INVENTION

A filling device for filling liquid containers is known from WO2010018139. The device of WO2010018139 comprises about thirty hose pumps. Each hose pump comprises a drive for driving the pump. Each drive comprises a power supply and a control line. A control unit is provided to activate each hose pump at the appropriate time. It was recognized in the present invention that the device of WO2010018139 is rather complex, and that a simplification is possible.

OBJECT OF THE INVENTION

It is an object of the invention to provide an improved filling device of the carrousel type.

It is an object of the invention to provide a practical, alternative filling device of the carrousel type.

SUMMARY OF THE INVENTION

In an embodiment, the invention provides a filling device, in particular for filling liquid containers of electronic cigarettes with a liquid, the filling device comprising:

- a rotary carrousel configured to rotate about a main axis of rotation,
- a pump cam track extending about the main axis, wherein the rotary carrousel comprises multiple hose pumps arranged in an annular configuration about said main axis, wherein each hose pump comprises:

- a hose,
- a rotary pump device, the rotary pump device comprising:
  - a roller rotor comprising a number of rollers which are configured to engage the hose and urge the liquid through the hose,
  - a cam rotor comprising a number of pump cams which are configured to engage the pump cam track, the cam rotor being coupled to the roller rotor, wherein the pump cam track comprises an inclined section configured to engage the pump cams and to rotate the rotary pump device of a hose pump during the rotary movement of the carrousel, wherein during the rotation of the rotary pump device a quantity of liquid is pumped into a container which is positioned in a container holder associated with said hose pump.

The invention provides a relatively simple and effective filling device.

In an embodiment, the hose pumps do not comprise any electric, pneumatic or hydraulic drive for driving the hose pumps and do not comprise any control lines for controlling such drives and/or power supply lines for providing power to such drives. This embodiment is simple and very effective. The hose pumps may comprise one or more actuators and control lines for controlling the actuators as will be discussed further below.

In an embodiment, each hose pump comprises a nozzle and a nozzle head which is constructed to move the nozzle downward into the container at the beginning of the pumping action and to move the nozzle upward and out of the container at the end of the pumping action. The movement of the nozzle head allows an insertion of the nozzle into the container which allows filling without leakage.

In an embodiment, the filling device comprises a nozzle cam track, and wherein each nozzle head comprises a nozzle cam which moves along said nozzle cam track for operating the upward and downward movement of the nozzle.

The nozzle cam track is a simple and reliable way of moving the nozzle. The combination with the pump cam track of the rotary pump device results in two cam tracks which create the required movements.

In an embodiment the filling device comprises container holders which are constructed to hold a container and to move along with an associated hose pump at least during the filling of the container by the hose pump. In this way a synchronized movement between the container holder and the hose pump is established, resulting in a reliable filling operation.

In an embodiment a rotation axis of the roller rotor and a rotation axis of the cam rotor is horizontal. It was found that this is a simple configuration. These rotation axes may be transverse to the main axis and transverse to a radius extending from the main axis of the carrousel to the respective hose pump.

In an embodiment, the roller rotor and the cam rotor have a common rotation axis. This allows a compact design of the hose pump, which is advantageous because several hose pumps need to be fitted into the carrousel.

In an embodiment, each hose pump comprises a hose section which is free to increase and decrease in curvature in order to allow the nozzle to move up and down without substantially affecting a volume inside a total length of hose inside the hose pump.

The hose section is located between the rotary pump device and the nozzle head and allows for accurate dosing of dosages into the container.

In an embodiment, each hose pump comprises a nozzle head of which the nozzle forms a part, and wherein each nozzle head further comprises a purging device configured for purging a quantity of liquid when a container position associated with the nozzle is empty, and/or, each hose pump comprises a controllable uncoupling device configured to controllably couple and uncouple the roller rotor and the cam rotor from one another, allowing the cam rotor to rotate while the roller rotor is stationary when a container holder associated with the nozzle is empty.

Because the individual hose pumps are driven by a pump cam track, it is not possible to prevent the cam rotor from rotating without an extra provision. If no extra provision is made, a quantity of liquid would always be pumped, even in a situation in which no container would be present. With these embodiments, it is possible to cope with empty container holders.

In an embodiment, the roller rotor and the cam rotor are fixed to one another and form an integrated rotor. This embodiment may be used in combination with the purging device or in a situation wherein no risk of empty container positions is present.

In an embodiment, the filling device comprises a purging device which comprises:

a purge channel, and a purge valve having a pump position and a purge position, wherein in the pump position the hose pump pumps liquid into the container and wherein in the purge position the hose pump pumps liquid into the purge channel.

The purging device may allow for re-use of the purged dosage by returning to the liquid to the reservoir, but the liquid may also be discarded.

In an embodiment, the filling device comprises:

a sensor configured to sense an empty container position, a control unit connected to the sensor and constructed to send an actuating signal to the purging device or the uncoupling device of the hose pump associated with the empty position in order to prevent liquid from being pumped onto the empty container position.

Advantageously, this embodiment creates full control of the hose pump and prevents pumping onto an empty container position.

In an embodiment each nozzle comprises a needle which is inserted into the container. The needle advantageously allows accurate filling.

Each cam rotor may comprises six pump cams. It was found that this is a practical number which allows accurate dosing.

In an embodiment, the hose pumps are arranged in a circle when viewed in the direction of the main axis. This was found to be a simply and regular arrangement.

In an embodiment, the hose pumps are connected to a reservoir from which the hose pumps receive liquid, and wherein the reservoir is located directly above the hose pumps.

The location of the reservoir allows short feeding channels to the hose pumps.

In an embodiment, the reservoir is positioned substantially coaxially with the main axis. In this way multiple same feeding channels can be provided, in particular one for each hose pump.

In an embodiment, the reservoir comprises multiple outlets, wherein each outlet is associated with a hose pump. Advantageously, less or no T-junctions or extra valves which need to be controlled are required in the feeding channels.

In an embodiment, the reservoir is rotary and configured to rotate with the carrousel. This advantageously creates a simple feeding mechanism.

In an embodiment, the inclined section is inclined upwardly when viewed in the direction of movement of the carrousel, wherein the pump cams which engage the inclined section move upward and the active roller or rollers of the roller rotor move downward. This was found to result in a very simple and effective configuration and allows easy replacement of the hose. An inverted configuration is also possible, i.e. the pump cams which are engaged by the pump cam track and the active rollers may both move downward.

In an embodiment, the rollers which act on the hose move downwardly and are located on the outer side of the carrousel, and the pump cams and rollers which move upwardly are located on the inner side of the carrousel. In another embodiment, the pump cam track and the pump cams in the pump cam track which move upwardly during the pumping are located on the outside.

The present invention further relates to a hose pump, comprising:

a hose, a rotary pump device, the rotary pump device comprising:

a roller rotor comprising a number of rollers which are configured to engage the hose and urge the liquid through the hose, and a cam rotor comprising a number of pump cams which are configured to engage a pump cam track, the cam rotor being coupled to the roller rotor.

The hose pump is suitable for use in the filling device according to the invention. In certain embodiments, the hose pump may be used independently from the carrousel.

The present invention further relates to a method of filling containers with a liquid, the method comprising:

providing a filling device, in particular for filling liquid containers of electronic cigarettes with a liquid, the filling device comprising:

a rotary carrousel configured to rotate about a main axis of rotation, a pump cam track extending about the main axis, wherein the rotary carrousel comprises multiple hose pumps arranged in an annular configuration about said main axis, wherein each hose pump comprises:

a hose, a rotary pump device, the rotary pump device comprising:

a roller rotor comprising a number of rollers which are configured to engage the hose and urge the liquid through the hose, a cam rotor comprising a number of pump cams which are configured to engage the pump cam track, the cam rotor being coupled to the roller rotor, wherein the pump cam track comprises an inclined section configured to engage the pump cams and to rotate the rotary pump device of a hose pump during the rotary movement of the carrousel, wherein during the rotation of the rotary pump device a quantity of liquid is pumped into a container positioned in a container holder which is associated with said hose pump, the method further comprising:

supplying an empty container to a container holder and moving said container along in close proximity with a nozzle of a hose pump on the rotating carrousel which is associated with the container holder, filling said container with the associated hose pump as the rotary pump device of the hose pump is rotated by the pump cam track during the rotary movement of the carrousel, removing the filled container from the container holder.

The method provides substantially the same benefits as the filling device according to the invention.

In an embodiment, the method comprises moving the nozzle downward at the beginning of the filling operation and moving the nozzle upward at the end of the filling operation.

In an embodiment, the method comprises purging a quantity of liquid with a purging device in case of an empty container position and/or uncoupling the roller rotor from the cam rotor in case of an empty container position.

These and other aspects of the invention will be more readily appreciated as the same becomes better understood by reference to the following detailed description and considered in connection with the accompanying drawings in which like reference symbols designate like parts.

SHORT DESCRIPTION OF THE FIGURES

DETAILED DESCRIPTION OF THE INVENTION

Figure 1:
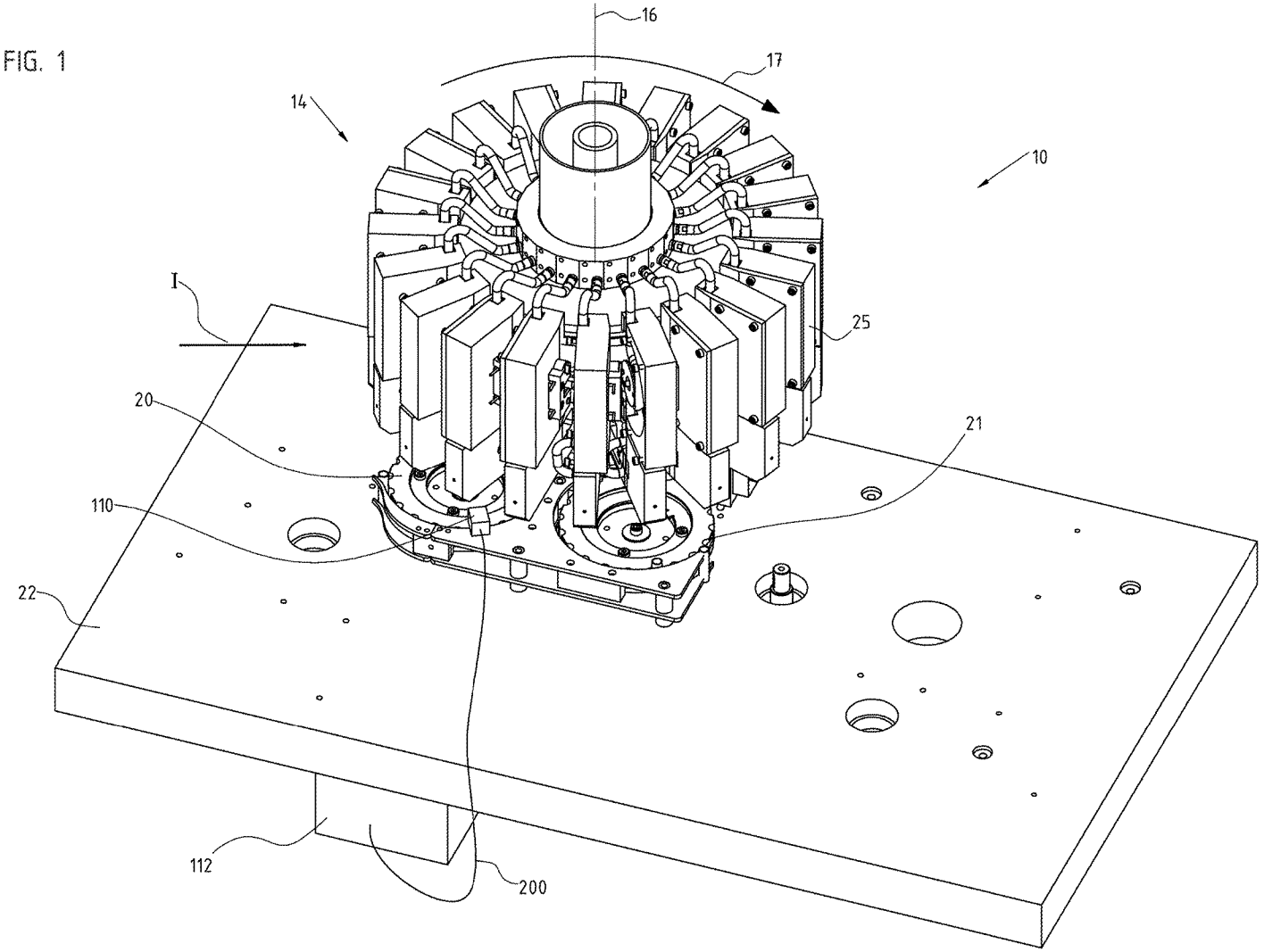
FIG. 1 shows an isometric view of a filling device according to the invention.
Figure 2:
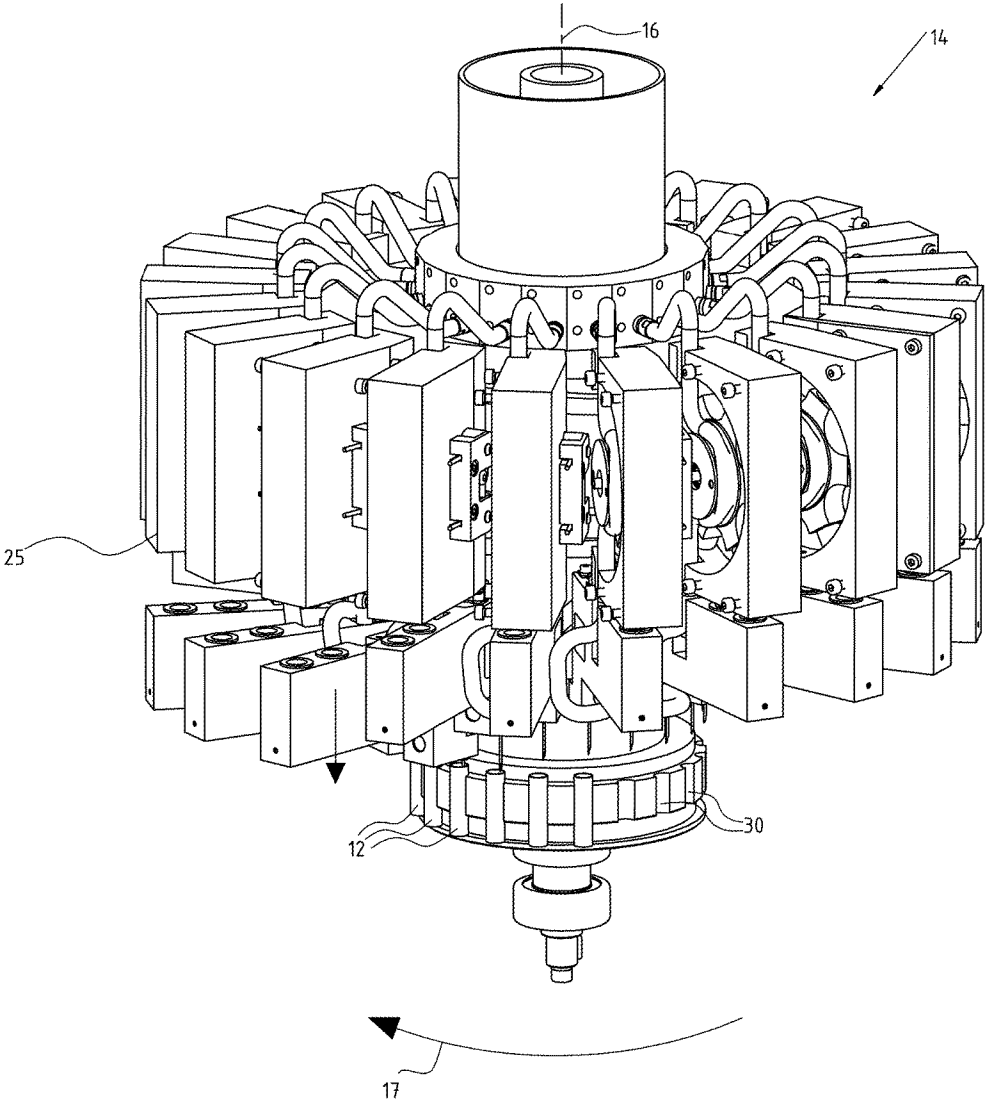
FIG. 2 shows an isometric view taken from direction I indicated in FIG. 1 of a part of the filling device according to the invention.

Turning to FIGS. 1 and 2, a filling device 10 according to the invention is shown. The filling device is in particular suitable for filling liquid containers 12 (shown in FIG. 2) of electronic cigarettes with a liquid. These containers are often indicated as cartridges.

The filling device may be arranged in an ongoing production line. A container supply device 20 and a container discharge device 21 are provided respectively upstream and downstream from the filling device 10. The container supply 20 device has the form of a rotary element and is configured to supply empty containers to the filling device 10. The container discharge device 21 also has the form of a rotary element and discharges the filled containers from the container filling device. Generally, the containers will be held upright throughout the production line, but other arrangements are possible. The various parts are mounted on a base plate 22.

The filling device comprises a rotary carrousel 14 configured to rotate about a main axis 16 of rotation. This axis may be vertical, but may also have another orientation. The carrousel rotates in the direction of arrow 17, i.e. clockwise in top view.

The rotary carrousel 14 comprises multiple hose pumps 25 arranged in an annular configuration about said main axis. The hose pumps are shown as boxes in FIG. 1. The filling device 10 comprises twenty hose pumps, but a different number is possible. In top view, the hose pumps have an annular arrangement.

The hose pumps are arranged in a circle when seen in top view. The hose pumps are arranged substantially above a container holder. Each hose pump is associated with a container holding position.

Figure 3:
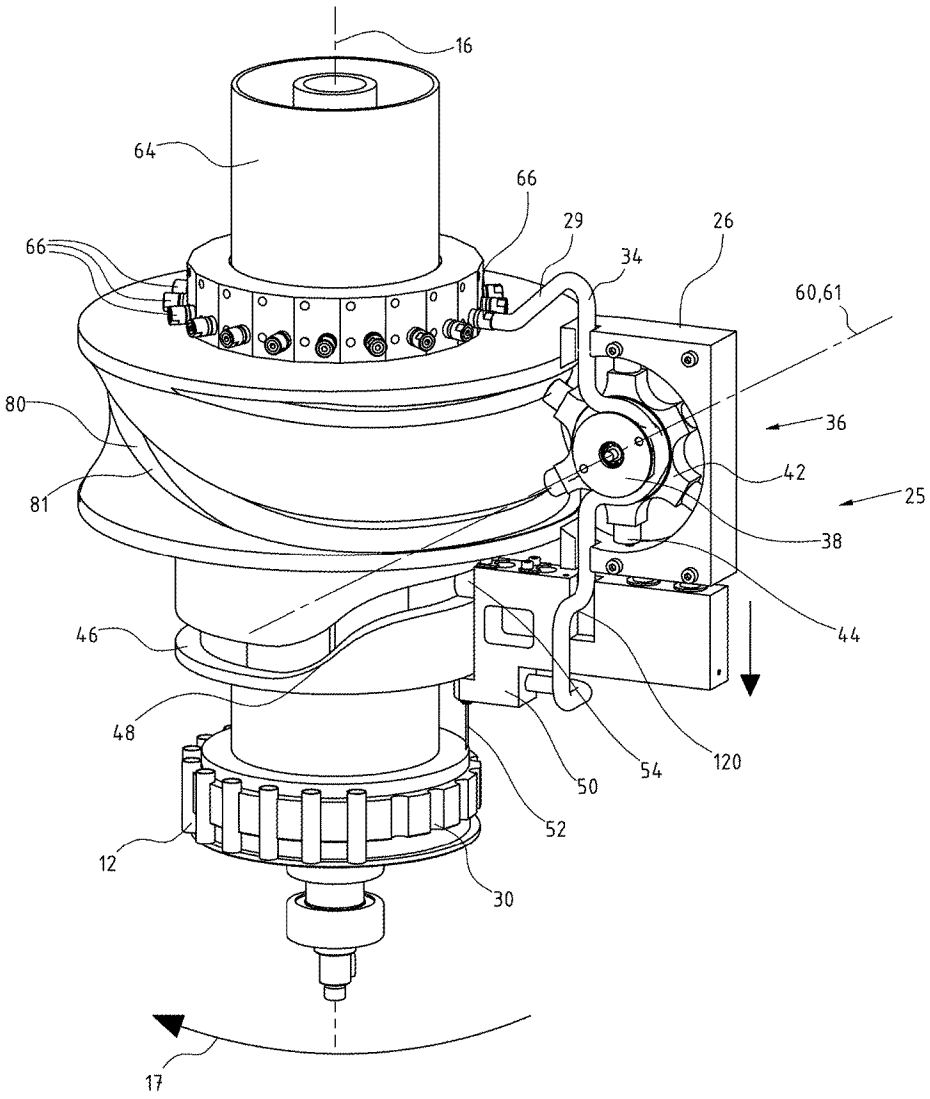
FIG. 3 shows an isometric view taken from direction I indicated in FIG. 1 of another part of the filling device according to the invention.
Figure 4:
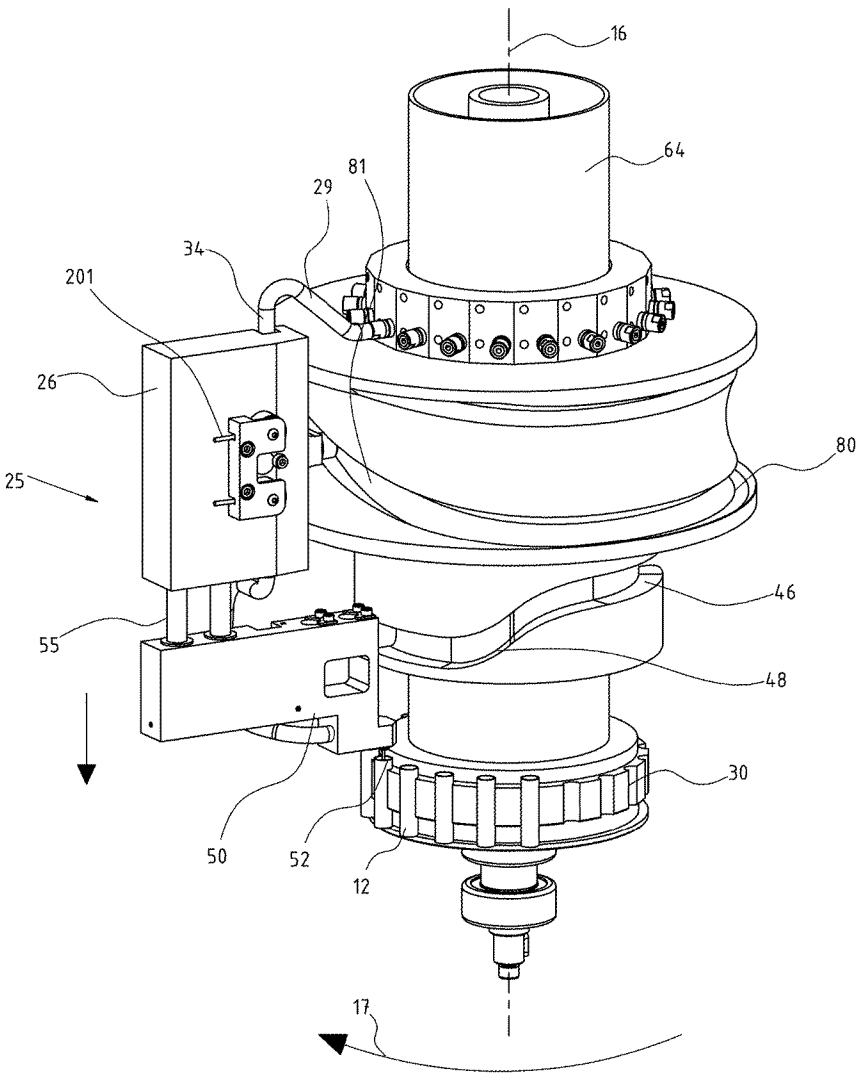
FIG. 4 shows an isometric view taken from direction I indicated in FIG. 1 of the same part shown in FIG. 3 in a different position.

Turning to FIGS. 3 and 4, each hose pump 25 comprises a hose 34 and a rotary pump device 36. The rotary pump device pumps the liquid through the hose. The rotary pump device comprises a roller rotor 38 comprising a number of rollers which are configured to engage the hose and urge the liquid through the hose. The rollers are discussed further below.

The rotary pump device comprises a cam rotor 42 comprising a number of pump cams 44. The pump cams 44 are configured to engage a pump cam track 80. The cam rotor 42 is coupled to the roller rotor 38. The cam rotor has six pump cams. A different number is possible. The pump cam track 80 will generally be stationary.

A rotation axis 60 of the roller rotor 38 and a rotation axis 61 of the cam rotor 42 may be aligned, i.e. the roller rotor may have a common rotation axis. Both axes 60, 61 may be horizontal and transverse to the main axis 16. The axes 60, 61 may extend transverse to a radius from the main axis 16 to the respective hose pump.

Each hose pump comprises a frame 26 which supports the roller rotor and the cam rotor and various other parts.

Each hose pump comprises a nozzle head 50. The nozzle head comprises a nozzle 52. The nozzle 52 has the form of a needle which is inserted into the container. Different nozzles than a needle are possible. The nozzle head 50 is constructed to move the nozzle downward into the container at the beginning of the pumping action and to move the nozzle upward and out of the container at the end of the pumping action. To this end, a nozzle cam track 46 extends about the main axis 16. The nozzle cam track has an inclined section 48.

Each hose pump comprises a hose section 120 which extends between the frame 26 and the nozzle head 50 and is free to increase and decrease in curvature in order to allow the nozzle head 50 to move up and down without substantially affecting a volume inside a total length of hose 34 inside the hose pump 25.

The nozzle head comprises a nozzle cam 54 which is rigidly coupled to the rest of the nozzle head 50. During the rotation of the carrousel, the nozzle cam 54 moves downward through the inclined section 48 and the nozzle is inserted into the container. Typically, this happens just prior to or at the beginning of the filling process. The nozzle cam track also comprises an upwardly inclined section for moving the nozzle head back upward at the end of the filling process.

A guide 55 is fixed to the frame 26 and guides the downward and upward movement of the nozzle head. It is also possible to mechanically invert this process, i.e. to move the container in the direction of the nozzle and keep the nozzle stationary.

The filling device 10 comprises container holders 30 which define a container position. The container holders 30 are semi-circular cavities which are constructed to hold a container and to move along with an associated hose pump at least during the filling of the container by the hose pump. The container holders may of course also be designed differently, for instance as clamps FIG. 3 further shows the reservoir 64 of the liquid. The reservoir 64 is part of the carrousel and rotates with the carrousel. The reservoir is coaxial with the main axis 16, but a non-coaxial arrangement is conceivable. The reservoir 64 is cylindrical and is positioned with an annular arrangement of hose pumps, when seen in top view.

The reservoir comprises multiple outlets 66, wherein each outlet is associated with a hose pump 25. The hose pumps are connected to the reservoir 64 from which the hose pumps receive liquid via a hose supply section 29.

In the position of FIG. 3, the hose pump 25 is above an empty container position and upstream of a filling zone of the filling device. The filling zone is defined by the inclined section 81 of the pump cam track 80. The nozzle head is in an upper position.

In the position of FIG. 4, the hose pump 25 is the filling zone. A container 12 has been supplied into the container holder 30 below the nozzle 52. The nozzle head 50 and the nozzle 52 have been moved downward by sliding through the inclined section 48 of the nozzle head cam track, so that the nozzle 52 extends into the container. The pump cam 44 is in an inclined section 81 of the pump cam track 80. The inclined section 81 is inclined upwardly when viewed in the direction of movement of the carrousel. During the rotary movement of the carrousel, the pump cam 44 moves along the inclined section 81 and liquid is pumped into the container 12. The pump cams 44 which engage the inclined section move upward and the active roller 39 or rollers of the roller rotor 38 move downward.

Figure 5:
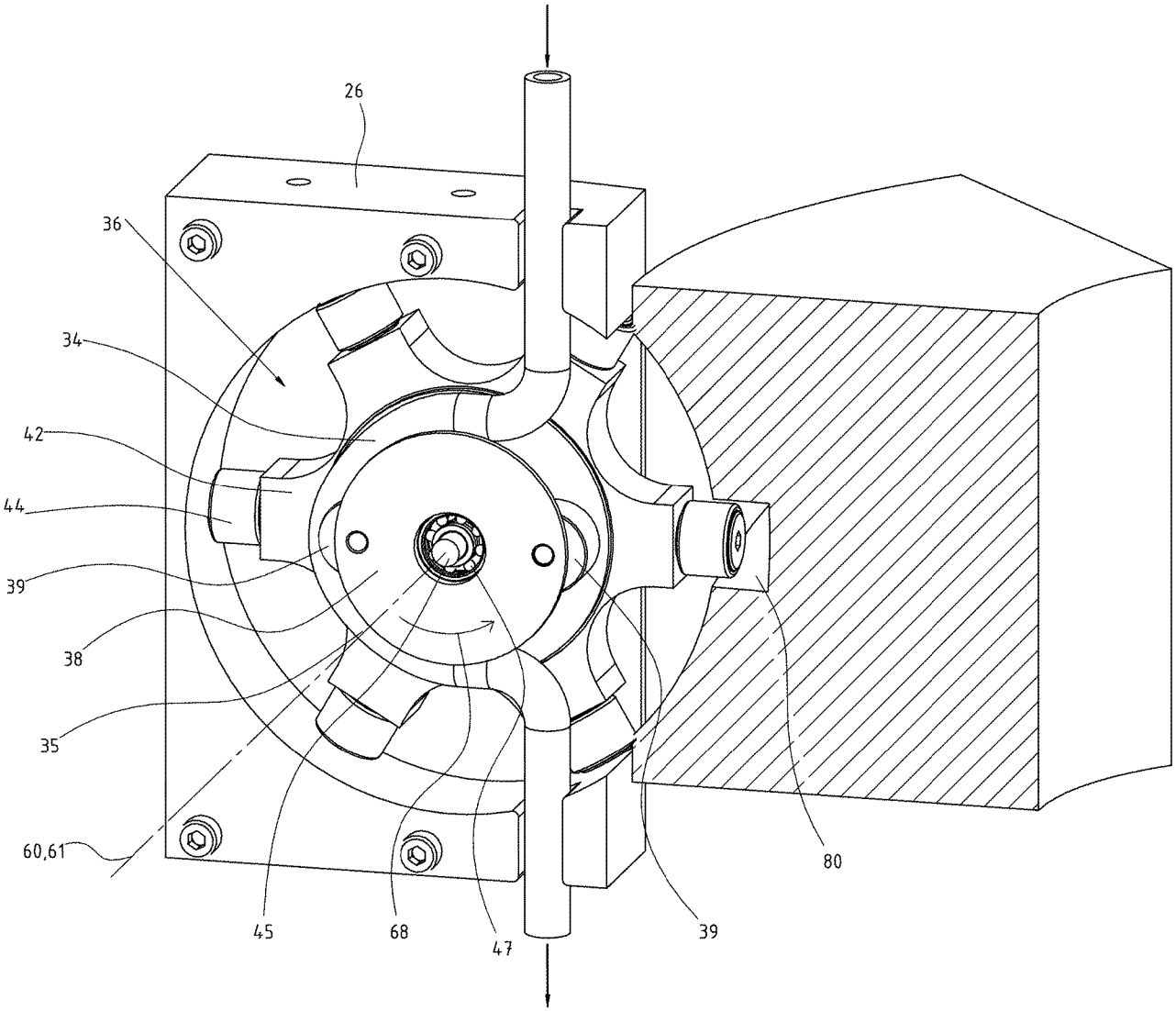
FIG. 5 shows an isometric view of a part of a hose pump according to the invention in close-up.

Turning to FIG. 5, a part of the hose pump is shown in close-up. The hose pump 25 comprises the frame 26 which takes the form of a housing. The frame 26 houses the roller rotor 38 and the cam rotor 42. The rotary pump device 36 comprises both the roller rotor and the cam rotor. The hose 34 has a curved section 35 which curves about the axis 60 of the roller rotor. Two rollers 39 are shown. The rollers press into the hose to close it locally in order to create the pumping action. In use, the hose pump turns in the direction of arrow 68. There are two rollers, but a different number is possible. The hose 34 extends in a vertical plane. An entry section and an exit section of the hose extend substantially vertically.

The roller rotor 38 and cam rotor 42 are fitted on a common axle 45 via respective bearings 47.

Figure 6:
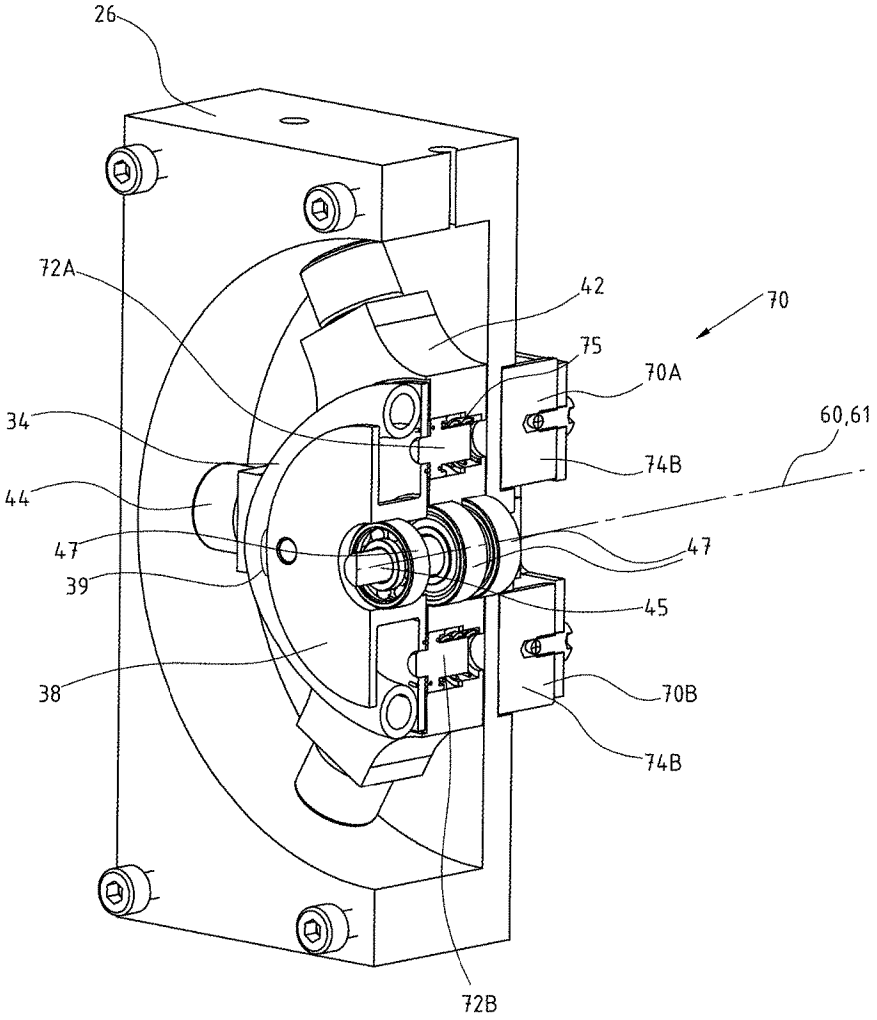
FIG. 6 shows a cut away isometric view of a part of the hose pump according to the invention.

Turning to FIG. 6, the roller rotor 38 and the cam rotor 42 are positioned coaxially and are coupled to one another via a controllable uncoupling device 70. The controllable uncoupling device 70 comprises two similar parts 70A, 70B. The controllable uncoupling device is configured to controllably uncouple the roller rotor 38 and the cam rotor 42 from one another.

The controllable uncoupling device comprises an actuator 74 (there are two, i.e. actuators 74A, 74B) and a pin 72 (there are two pins 72A, 72B) which can be retracted from an inserted position in which the pins extend through a hole in the roller rotor 38 to a retracted position in the cam rotor in which the pins are retracted from the respective holes in the roller rotor. The actuators 74A, 74B are electromagnets which can pull the respective pins 72A, 72B against the action of respective springs 75.

The default position is a coupled position, i.e. when the actuator is not actuated, the roller rotor 38 and the cam rotor 42 are coupled, thereby forcing these to rotate in unison. By actuating the actuators 74A, 74B, the pins 72A, 72B are retracted and the roller rotor and the cam rotor are uncoupled. In this way, the cam rotor 42 can be rotated while the roller rotor 38 remains stationary. This allows the cam rotor to rotate while the roller rotor is stationary, for instance in order to prevent pumping when there is no container 12 positioned underneath the nozzle. The uncoupling device acts like a clutch.

Returning to FIG. 1, the filling device may comprise a sensor 110 configured to sense an empty container holder 30 and a control unit 112 connected to the sensor and constructed to send an actuating signal to the uncoupling device 70 of the hose pump 25 associated with the empty position in order to prevent liquid from being pumped onto the empty container position. The sensor may be a camera. The sensor is coupled with the control device 112 via a control line, see FIG. 1. Each uncoupling device is also coupled with the control device via a control line 201, see FIG. 4.

It is also possible to carry out the sensor as a mechanical sensor which is mechanically coupled to the nozzle head.

Figure 7:
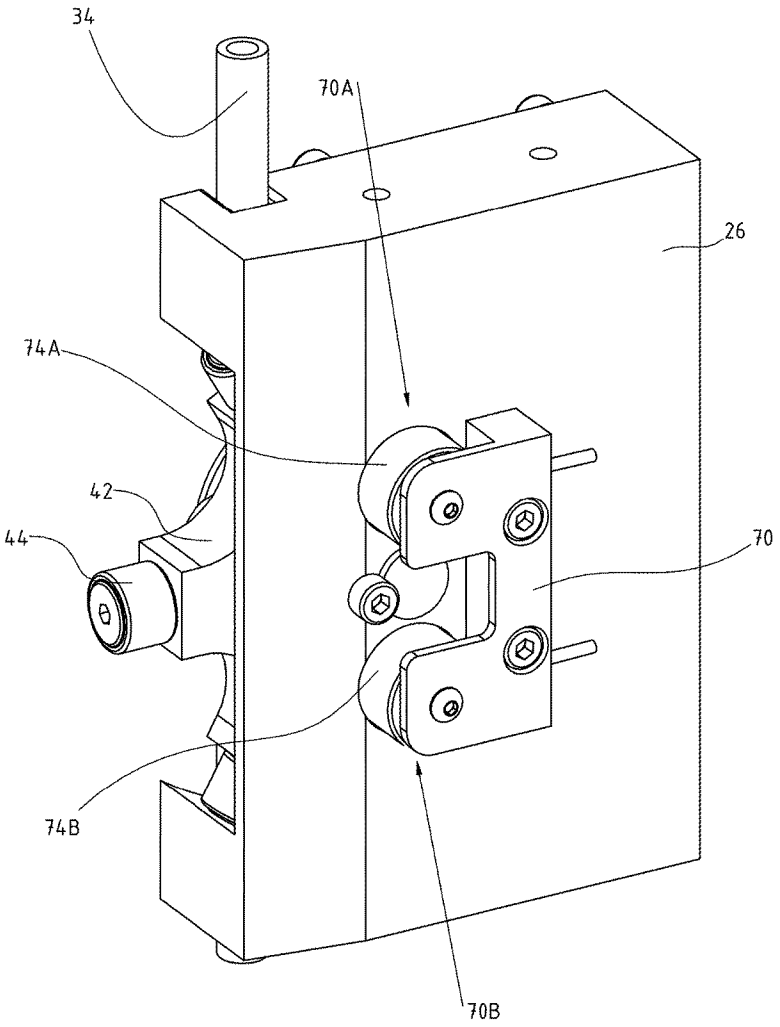
FIG. 7 shows a rear isometric view of a part of the hose pump according to the invention.

Turning to FIG. 7, the uncoupling devices 70A, 70B are mounted on the outside of the frame 26. Each uncoupling device 70A, 70B is configured to retract a pin from an opening in the roller rotor.

Figure 8:
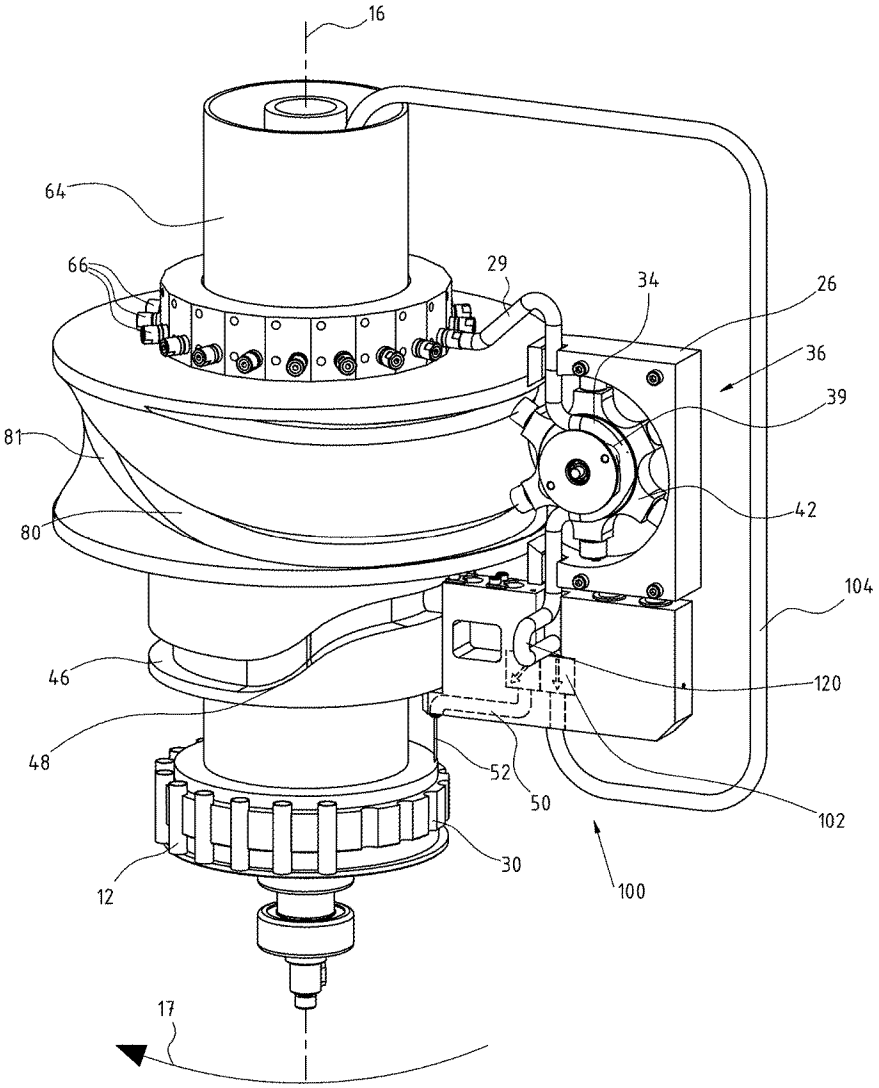
FIG. 8 shows an isometric view taken from direction I indicated in FIG. 1 of an embodiment of a part of the filling device comprising a purging device.

Turning to FIG. 8, as an alternative or in addition to the uncoupling device 70, each hose pump 25 comprises a purging device 100 to prevent the pumping of liquid in case of an empty container position. The purging device comprises a controllable valve 102 which either sends the liquid to the nozzle 52 or sends the liquid into a return channel 104, also indicated as purge channel 104. The return channel 104 extends from the nozzle head 50 back to the reservoir 64.

In an embodiment, the roller rotor and the cam rotor may be fixed to one another and form an integrated rotor, i.e. without a controllable uncoupling device.

The controllable valve 102 is also indicated as purge valve and has a pump position and a purge position. In the pump position the hose pump pumps liquid into the container and in the purge position the hose pump pumps liquid into the purge channel. In use, a quantity of liquid is purged with a purging device in case of an empty container position, thereby preventing spilling of liquid. Alternatively or additionally, the roller rotor may be uncoupled from the cam rotor in case of an empty container position.

The controllable valve 102 will be coupled to the control device 112 via a control line in a similar fashion as the uncoupling device 70.

Figure 9:
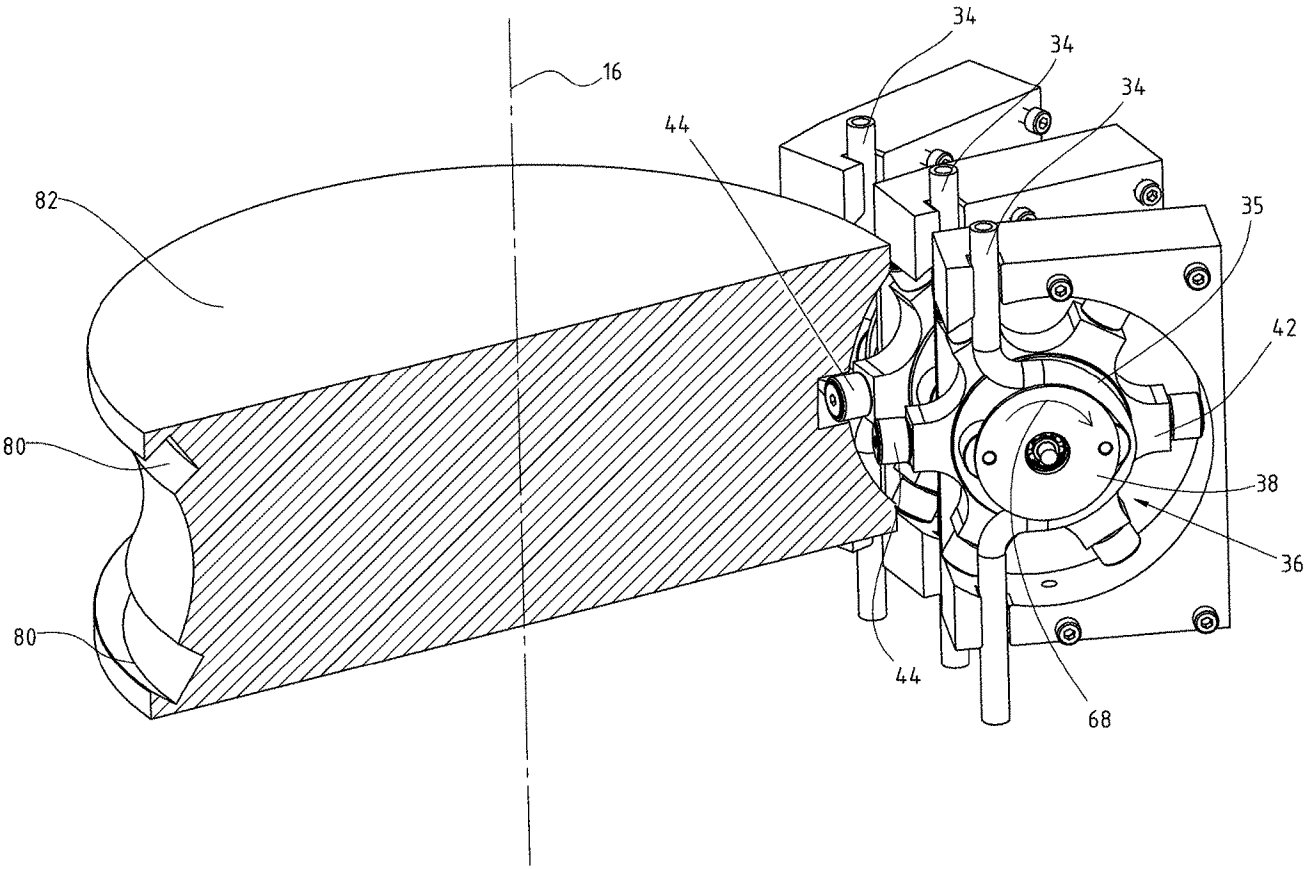
FIG. 9 shows a partial isometric view of a part of a number of hose pumps and a pump cam track according to the invention.

Turning to FIG. 9, the pump cam track 80 is shown. The hose pumps 25 are shown without the nozzle heads. The pump cam track 80 is a globoidal cam track and extends through an outer circumference of a cam body 82. The outer circumference is concave. The pump cam track 80 has a section which is inclined downwardly in the direction of travel, thereby forcing the pump cam 44 in the pump cam track upwardly and rotating the rotary pump device in the direction of arrow 68. The pump cam track may not be endless, i.e. may not extend fully around the main axis. The pump cam track 80 is arranged along the inner sides of the hose pumps 25.

Figure 10:
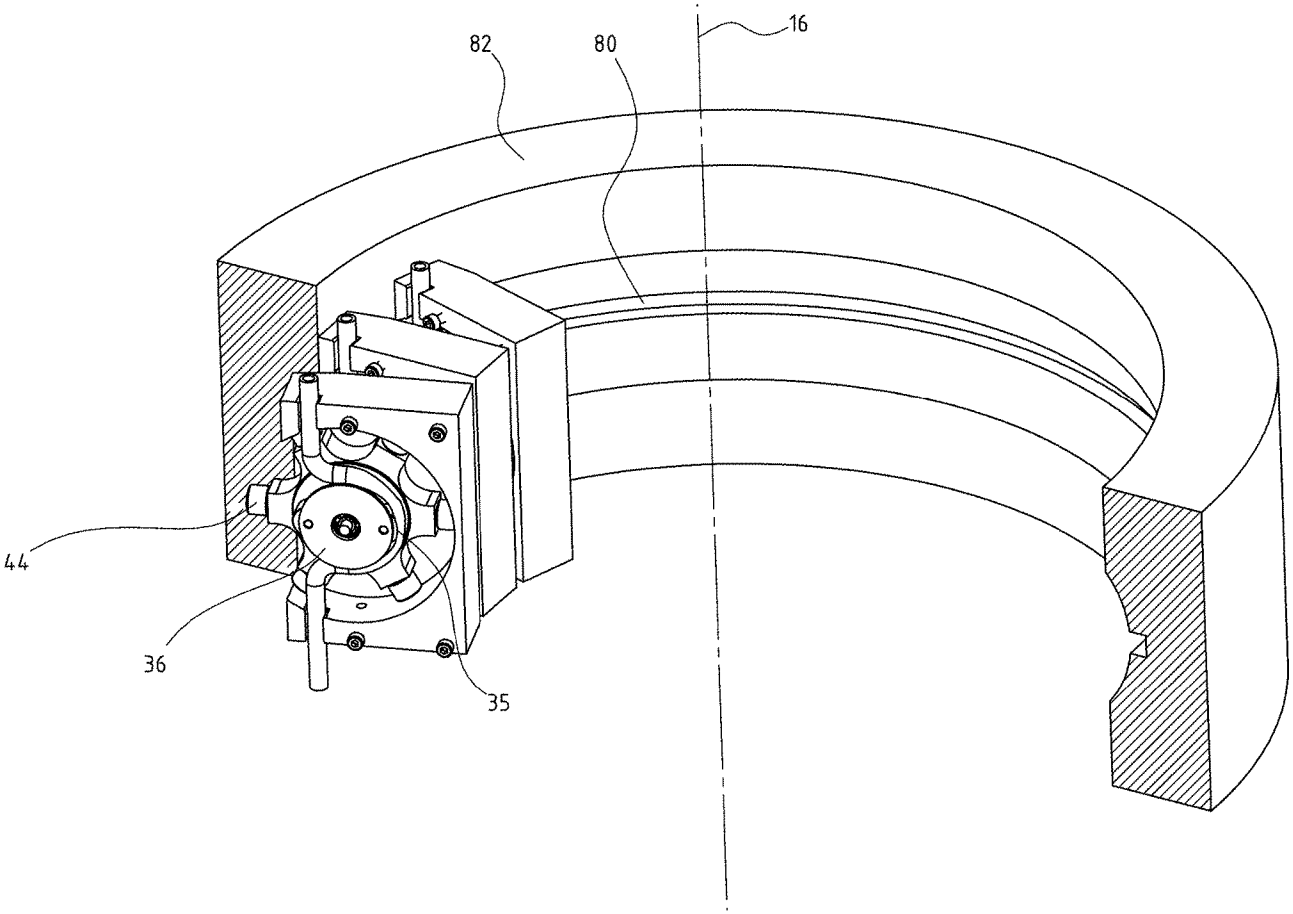
FIG. 10 shows another embodiment of a a part of filling device according to the invention.

Turning to FIG. 10, a variant is shown wherein the pump cam track 80 is provided in an annular cam track body 82 which extends along the outside of the carrousel. The curved section 35 of the hose curves in an opposite direction as in the embodiment of FIG. 9, i.e. the curved section defines a loop which is looped towards the main axis 16 instead of away from the main axis 16.

Operation

In use, the filling device 10 is used to fill containers 12 with a liquid. Each time an empty container 12 is supplied and said container is moved along in close proximity with a nozzle 52 of a hose pump on the rotating carrousel. Each time the container is filled with the associated hose pump as the rotary pump device 36 of the hose pump is rotated by the pump cam track during the rotary movement of the carrousel.

The filling device operates continuously, i.e. the containers can move continuously and do not need to be stopped in order to be filled.

During the rotation of the carrousel, each time a pump cam of a passing hose pump will enter the pump cam track 80. The pump cam track comprises an inclined section 81. When the pump cam 44 passes through the inclined section 81, the cam rotor 42 will rotate.

The hose pumps may be free of an electric, pneumatic or hydraulic drive for driving the hose pumps. In an embodiment the hose pumps do not comprise any control lines for controlling such drives and/or power supply lines for providing power to such drives. The hose pumps may comprise control lines for the uncoupling device and/or for the purging device.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The present invention is a very practical and efficient device.

The present invention may in particular be used to fill containers of e-cigarettes. Other fields of use may be possible. The filling device may for instance be used to fill bottles with beverages or bottles with medicine or cartridges filled with ink.

In the present document, the words "hose pump" cover a peristaltic pump.

In the present document, the word "roller" is used to indicate the members which urge the liquid through the hose. Peristaltic pumps having shoes, i.e. non-rolling members, are also known, in particular for higher pressures. In the present document, the word "roller" is to be interpreted broadly as encompassing these shoes.

Containers of electronic cigarette are often indicated as cartridge. In the present document, the word container is to be interpreted broadly and as encompassing the word cartridge.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

CLAUSES

1. Filling device (10), in particular for filling liquid containers (12) of electronic cigarettes with a liquid, the filling device comprising:
   - a rotary carrousel (14) configured to rotate about a main axis (16) of rotation,
   - a pump cam track (80) extending about the main axis (16),
   - wherein the rotary carrousel comprises multiple hose pumps (25) arranged in an annular configuration about said main axis, wherein each hose pump comprises:
     - a hose (34),
     - a rotary pump device (36), the rotary pump device comprising:
       - a roller rotor (38) comprising a number of rollers (39) which are configured to engage the hose and urge the liquid through the hose,
       - a cam rotor (42) comprising a number of pump cams (44) which are configured to engage the pump cam track (80), the cam rotor being coupled to the roller rotor,
     - wherein the pump cam track comprises an inclined section (81) configured to engage the pump cams and to rotate the rotary pump device of a hose pump during the rotary movement of the carrousel, wherein during the rotation of the rotary pump device a quantity of liquid is pumped into a container positioned in a container holder (30) which is associated with said hose pump.

2. Filling device according to claim 1, wherein the hose pumps do not comprise any electric, pneumatic or hydraulic drive for driving the hose pumps and do not comprise any control lines for controlling such drives and/or power supply lines for providing power to such drives.

3. Filling device according to any of the preceding clauses, wherein each hose pump comprises a nozzle head (50) which is constructed to move a nozzle (52) downward into the container at the beginning of the pumping action and to move the nozzle upward and out of the container at the end of the pumping action.

4. Filling device according to the preceding clause, wherein the filling device comprises a nozzle cam track (46), and wherein each nozzle head comprises a nozzle cam (54) which moves along said nozzle cam track for operating the upward and downward movement of the nozzle (52).

5. Filling device according to any of the preceding clauses, comprising container holders (30) which are constructed to hold a container and to move along with an associated hose pump (25) at least during the filling of the container by the hose pump.

6. Filling device according to any of the preceding clauses, wherein a rotation axis (60) of the roller rotor (38) and a rotation axis (61) of the cam rotor (42) is transverse to the main axis and in particular is horizontal.

7. Filling device according to any of the preceding clauses, wherein the roller rotor and the cam rotor have a common rotation axis.

8. Filling device according to any clauses 6-7, wherein each hose pump comprises a hose section (120) which is free to increase and decrease in curvature in order to allow the nozzle to move up and down without substantially affecting a volume inside a total length of hose inside the hose pump.

9. Filling device according to any of the preceding clauses, wherein each hose pump comprises a nozzle head (50) of which the nozzle forms a part, and wherein each nozzle head further comprises a purging device (100) configured for purging a quantity of liquid when a container holder (30) associated with the nozzle is empty and/or wherein each hose pump (25) comprises a controllable uncoupling device (70) configured to controllably couple and uncouple the roller rotor and the cam rotor from one another, allowing the cam rotor to rotate while the roller rotor is stationary when a container holder (30) associated with the nozzle is empty.

10. Filling device according to any of the preceding clauses except the previous clause, wherein the roller rotor and the cam rotor are fixed to one another and form an integrated rotor.

11. Filling device according to any of the preceding clauses, comprising a purging device which comprises:

a purge channel (104), and a purge valve (102) having a pump position and a purge position, wherein in the pump position the hose pump pumps liquid into the container and wherein in the purge position the hose pump pumps liquid into the purge channel.

12. Filling device according to any of the preceding clauses, comprising:

a sensor (110) configured to sense an empty container holder (30), a control unit (112) connected to the sensor and constructed to send an actuating signal to the purging device (100) or the uncoupling device (70) of the hose pump (25) associated with the empty position in order to prevent liquid from being pumped onto the empty container position.

13. Filling device according to any of the preceding clauses, wherein each nozzle has the form of a needle which is inserted into the container.

14. Filling device according to any of the preceding clauses, wherein each cam rotor comprises six pump cams (44).

15. Filling device according to any of the preceding clauses, wherein the hose pumps are arranged in a circle when viewed in the direction of the main axis.

16. Filling device according to any of the preceding clauses, wherein the hose pumps are connected to a reservoir from which the hose pumps receive liquid, and wherein the reservoir is located directly above the hose pumps.

17. Filling device according to any of the preceding clauses, wherein the hose pumps are connected to a reservoir from which the hose pumps receive liquid, and wherein the reservoir is positioned substantially coaxially with the main axis.

18. Filling device according to any of the preceding clauses, wherein the hose pumps are connected to a reservoir (64) from which the hose pumps receive liquid, and wherein the reservoir comprises multiple outlets (66), wherein each outlet is associated with a hose pump.

19. Filling device according to any of the preceding clauses, wherein the hose pumps are connected to a reservoir from which the hose pumps receive liquid, and wherein the reservoir is rotary and configured to rotate with the carrousel.

20. Filling device according to any of the preceding clauses, wherein the inclined section is inclined upwardly when viewed in the direction of movement of the carrousel, wherein the pump cams which engage the inclined section move upward and the active roller or rollers of the roller rotor move downward.

21. Hose pump (25), comprising:

a hose (34), a rotary pump device (36), the rotary pump device comprising:

a. a roller rotor (38) comprising a number of rollers (39) which are configured to engage the hose and urge the liquid through the hose, b. a cam rotor (42) comprising a number of pump cams (44) which are configured to engage a pump cam track (80), the cam rotor being coupled to the roller rotor.

22. Method of filling containers with a liquid, the method comprising:

providing a filling device (10) in particular for filling liquid containers (12) of electronic cigarettes with a liquid, the filling device comprising:

a rotary carrousel (14) configured to rotate about a main axis (16) of rotation, a pump cam track (80) extending about the main axis (16), wherein the rotary carrousel comprises multiple hose pumps (25) arranged in an annular configuration about said main axis, wherein each hose pump comprises:

a hose (34), a rotary pump device (36), the rotary pump device comprising:

a roller rotor (38) comprising a number of rollers (39) which are configured to engage the hose and urge the liquid through the hose, a cam rotor (42) comprising a number of pump cams (44) which are configured to engage the pump cam track (80), the cam rotor being coupled to the roller rotor, wherein the pump cam track comprises an inclined section (81) configured to engage the cams and to rotate the rotary pump device of a hose pump during the rotary movement of the carrousel, wherein during the rotation of the rotary pump device a quantity of liquid is pumped into a container positioned in a container holder (30) which is associated with said hose pump, the method further comprising:

supplying an empty container (12) to a container holder (30) and moving said container along in close proximity with a nozzle of a hose pump on the rotating carrousel which is associated with the container holder, filling said container with the associated hose pump as the rotary pump device (36) of the hose pump is rotated by the pump cam track during the rotary movement of the carrousel, removing the filled container from the container holder.

23. Method of any of the preceding method clauses, comprising moving the nozzle downward at the beginning of the filling operation and moving the nozzle upward at the end of the filling operation.

24. Method of any of the preceding method clauses, comprising purging a quantity of liquid with a purging device in case of an empty container position or uncoupling the roller rotor from the cam rotor in case of an empty container position.

The invention claimed is:

1. A filling device for filling liquid containers of electronic cigarettes with a liquid, the filling device comprising:

a rotary carrousel configured to rotate about a main axis of rotation, a pump cam track extending about the main axis, wherein the rotary carrousel comprises multiple hose pumps arranged in an annular configuration about said main axis, wherein each hose pump comprises:

a hose, a rotary pump device, the rotary pump device comprising:

a roller rotor comprising a number of rollers which are configured to engage the hose and urge the liquid through the hose, a cam rotor comprising a number of pump cams which are configured to engage the pump cam track, the cam rotor being coupled to the roller rotor, wherein the pump cam track comprises an inclined section configured to engage the pump cams and to rotate the rotary pump device of a hose pump during the rotary movement of the carrousel, wherein during the rotation of the rotary pump device a quantity of liquid is pumped into a container positioned in a container holder which is associated with said hose pump.

2. The filling device according to claim 1, wherein the hose pumps do not comprise any electric, pneumatic or hydraulic drive for driving the hose pumps and do not comprise any control lines for controlling such drives and/or power supply lines for providing power to such drives.

3. The filling device according to claim 1, wherein each hose pump comprises a nozzle head which is constructed to move a nozzle downward into the container at the beginning of the pumping action and to move the nozzle upward and out of the container at the end of the pumping action.

4. The filling device according to claim 3, wherein the filling device comprises a nozzle cam track, and wherein each nozzle head comprises a nozzle cam which moves along said nozzle cam track for operating the upward and downward movement of the nozzle.

5. The filling device according to claim 1, comprising container holders which are constructed to hold a container and to move along with an associated hose pump at least during the filling of the container by the hose pump.

6. The filling device according to claim 1, wherein a rotation axis of the roller rotor and a rotation axis of the cam rotor are transverse to the main axis.

7. The filling device according to claim 1, wherein the roller rotor and the cam rotor have a common rotation axis.

8. The filling device according to claim 1, wherein each hose pump comprises a nozzle head of which the nozzle forms a part, and wherein each nozzle head further comprises a purging device configured for purging a quantity of liquid when a container holder associated with the nozzle is empty and/or wherein each hose pump comprises a controllable uncoupling device configured to controllably couple and uncouple the roller rotor and the cam rotor from one another, allowing the cam rotor to rotate while the roller rotor is stationary when a container holder associated with the nozzle is empty.

9. The filling device according to claim 1, wherein the roller rotor and the cam rotor are fixed to one another and form an integrated rotor.

10. The filling device according to claim 1, comprising a purging device which comprises:

a purge channel, and a purge valve having a pump position and a purge position, wherein in the pump position the hose pump pumps liquid into the container and wherein in the purge position the hose pump pumps liquid into the purge channel.

11. The filling device according to claim 1, comprising:

a sensor configured to sense an empty container holder, and a control unit connected to the sensor and constructed to send an actuating signal to the purging device or the uncoupling device of the hose pump associated with the empty position in order to prevent liquid from being pumped onto the empty container position.

12. The filling device according to claim 1, wherein each nozzle has the form of a needle which is inserted into the container.

13. The filling device according to claim 1, wherein each cam rotor comprises six pump cams.

14. The filling device according to claim 1, wherein the hose pumps are arranged in a circle when viewed in the direction of the main axis.

15. The filling device according to claim 1, wherein the hose pumps are connected to a reservoir from which the hose pumps receive liquid, comprising at least one of the following features:

wherein the reservoir is located directly above the hose pumps;

wherein the reservoir is positioned substantially coaxially with the main axis;

wherein the reservoir comprises multiple outlets, wherein each outlet is associated with a hose pump; and wherein the reservoir is rotary and configured to rotate with the carrousel.

16. The filling device according to claim 1, wherein the inclined section is inclined upwardly when viewed in the direction of movement of the carrousel, wherein the pump cams which engage the inclined section move upward and the active roller or rollers of the roller rotor move downward.

17. The filling device according to claim 6, wherein the rotation axis of the roller rotor and the rotation axis of the cam rotor are horizontal.

18. A method of filling containers with a liquid, the method comprising:

providing a filling device for filling liquid containers of electronic cigarettes with a liquid, the filling device comprising:

a rotary carrousel configured to rotate about a main axis of rotation, a pump cam track extending about the main axis, wherein the rotary carrousel comprises multiple hose pumps arranged in an annular configuration about said main axis, wherein each hose pump comprises:

a hose, a rotary pump device, the rotary pump device comprising:

a roller rotor comprising a number of rollers which are configured to engage the hose and urge the liquid through the hose, a cam rotor comprising a number of pump cams which are configured to engage the pump cam track, the cam rotor being coupled to the roller rotor, wherein the pump cam track comprises an inclined section configured to engage the cams and to rotate the rotary pump device of a hose pump during the rotary movement of the carrousel, wherein during the rotation of the rotary pump device a quantity of liquid is pumped into a container positioned in a container holder which is associated with said hose pump, the method further comprising:

supplying an empty container to a container holder and moving said container along in close proximity with a nozzle of a hose pump on the rotating carrousel which is associated with the container holder, filling said container with the associated hose pump as the rotary pump device of the hose pump is rotated by the pump cam track during the rotary movement of the carrousel, removing the filled container from the container holder.

19. The method of claim 18, comprising moving the nozzle downward at the beginning of the filling operation and moving the nozzle upward at the end of the filling operation.

20. The method of claim 18, comprising purging a quantity of liquid with a purging device in case of an empty container position or uncoupling the roller rotor from the cam rotor in case of an empty container position.

* * * * *